US011655065B2

(12) United States Patent
Simpkins et al.

(10) Patent No.: US 11,655,065 B2
(45) Date of Patent: May 23, 2023

(54) SHIPPERS WITH AIR CELLS

(71) Applicant: WestRock Shared Services, LLC, Atlanta, GA (US)

(72) Inventors: Kevin M. Simpkins, Cumming, GA (US); Craig W. Buscema, Douglasville, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 131 days.

(21) Appl. No.: 16/426,139

(22) Filed: May 30, 2019

(65) Prior Publication Data

US 2019/0382157 A1 Dec. 19, 2019

Related U.S. Application Data

(60) Provisional application No. 62/684,242, filed on Jun. 13, 2018.

(51) Int. Cl.

| | |
|---|---|
| ***B65D 5/50*** | (2006.01) |
| ***B65D 5/42*** | (2006.01) |
| ***B31B 50/26*** | (2017.01) |
| ***B31B 50/81*** | (2017.01) |
| ***B31B 50/00*** | (2017.01) |
| *B31B 100/00* | (2017.01) |

(52) U.S. Cl.

CPC ..... *B65D 5/5011* (2013.01); *B31B 50/0044* (2017.08); *B31B 50/262* (2017.08); *B31B 50/81* (2017.08); *B65D 5/4266* (2013.01); *B31B 2100/0024* (2017.08)

(58) Field of Classification Search

CPC ..... B65D 5/5011; B65D 5/4266

USPC ..... 206/588, 589, 592, 594, 784; 229/120.18, 120.21, 120.08, 120.11, 229/120.13, 120.14, 120.15

See application file for complete search history.

(56) References Cited

U.S. PATENT DOCUMENTS

| | | | | | |
|---|---|---|---|---|---|
| 1,039,026 | A * | 9/1912 | Carter | B65D 85/42 | 206/418 |
| 1,352,759 | A * | 9/1920 | Markert | B65D 5/5014 | 206/589 |
| 2,595,202 | A * | 4/1952 | Pardee | B65D 5/4204 | 229/120.15 |
| 3,240,417 | A * | 3/1966 | Andreini | B65D 5/5016 | 206/455 |
| 3,349,986 | A * | 10/1967 | Chapman | B65D 5/76 | 229/117.3 |
| 3,656,612 | A * | 4/1972 | Sellors | B65D 5/5007 | 206/782 |

(Continued)

*Primary Examiner* — Jacob K Ackun

(74) *Attorney, Agent, or Firm* — Rohini K Garg

(57) ABSTRACT

A container includes a plurality of panels connected together at fold lines configured for extending at least partially around an interior space, including a front panel, a first side panel, a back panel and a second side panel. A plurality of end flaps are included, each end flap foldably connected to a respective one of the panels. The end flaps are overlapped with one another to enclose an end of the interior space. An air cell flap is foldably connected to at least one of the end flaps and/or one of the panels, wherein the air cell flap is within the interior space and is inwardly offset from the end flaps to define an air cell between the air cell flap and the end flaps to protect product within the interior space.

4 Claims, 15 Drawing Sheets

(56) References Cited

U.S. PATENT DOCUMENTS

| | | | | | |
|---|---|---|---|---|---|
| 3,685,640 | A * | 8/1972 | Tolaas | B65D 5/4204 | 206/730 |
| 4,131,198 | A * | 12/1978 | Fischer | B65D 71/16 | 206/419 |
| 4,383,612 | A * | 5/1983 | Pawlowski | B65D 5/5014 | 206/525 |
| 5,158,178 | A * | 10/1992 | Cobler | B65D 5/32 | 206/256 |
| 5,228,589 | A * | 7/1993 | Della Riva | B65D 77/065 | 206/229 |
| 5,901,852 | A * | 5/1999 | Simpson | B65D 5/029 | 206/583 |
| 6,755,324 | B2 * | 6/2004 | Geshay | B65D 77/067 | 222/1 |
| 7,681,783 | B2 * | 3/2010 | Stephenson | B65D 5/4608 | 229/117.3 |
| 9,051,110 | B2 * | 6/2015 | Gatto | B65D 77/02 | |
| 2004/0195299 | A1 * | 10/2004 | Petrelli | B65D 5/725 | 229/120.15 |

* cited by examiner

Fig. 10
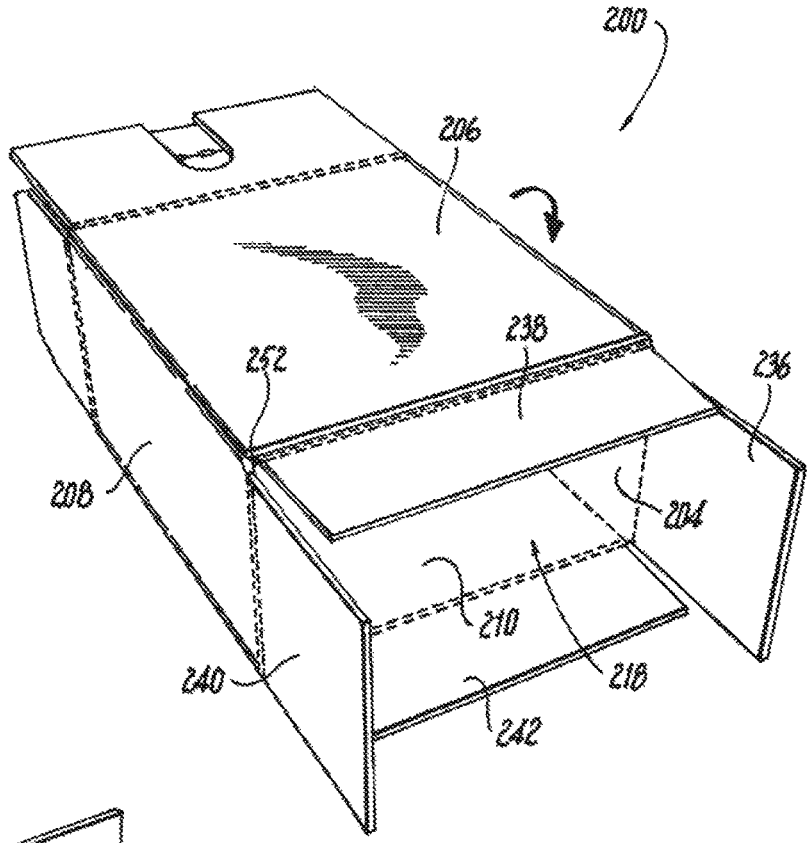
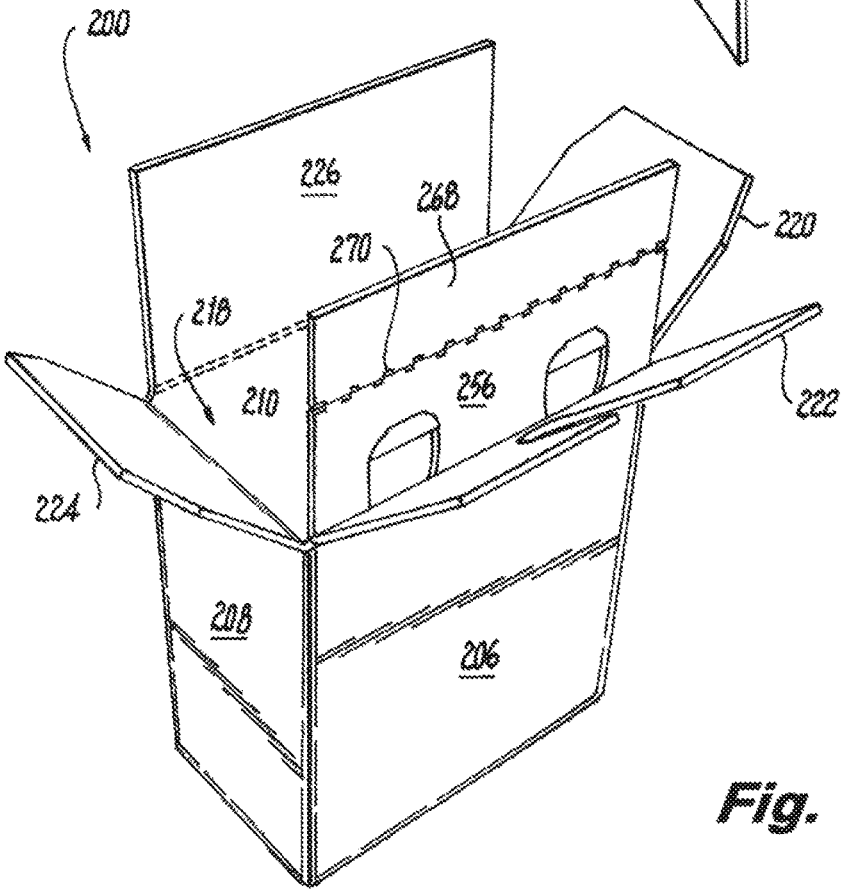
Fig. 11

SHIPPERS WITH AIR CELLS

REFERENCE TO RELATED APPLICATION

This application claims the benefit of priority under 35 U.S.C. § 119(e) of U.S. provisional application Ser. No. 62/684,242 filed on Jun. 13, 2018, which is hereby incorporated by reference in its entirety.

BACKGROUND OF THE INVENTION

Field of the Invention

The present disclosure relates to shipping containers, and more particularly to shipping containers with features to protect product within the shipping containers from impact and the like.

Description of Related Art

Products that up until recently were almost exclusively purchased in a physical retail setting, such as food products, beverage products, soap and cleaning products, and the like, are increasingly available to consumers through eCommerce venders that ship the products directly to the consumer. For shipping purposes there is a concomitant shift from shipping in bulk to shipping products on an individual basis. For example, when a bottled product is purchased through eCommerce, it must be shipped individually to the consumer, whereas in the traditional retail setting the bottles were only shipped in bulk. Traditionally, eCommerce products are packed in standard boxes with standard packing such as bubble wrap as needed.

The conventional techniques have been considered satisfactory for their intended purpose. However, there is an ever present need for improved packaging, e.g. for shipping eCommerce products and the like. This disclosure provides a solution for this need.

SUMMARY OF THE INVENTION

A container includes a plurality of panels connected together at fold lines configured for extending at least partially around an interior space, including a front panel, a first side panel, a back panel and a second side panel. A plurality of end flaps are included, each end flap foldably connected to a respective one of the panels. The end flaps are overlapped with one another to enclose an end of the interior space. An air cell flap is foldably connected to at least one of the end flaps and/or one of the panels, wherein the air cell flap is within the interior space and is inwardly offset from the end flaps to define an air cell between the air cell flap and the end flaps to protect product within the interior space.

The air cell flap can define at least one product aperture therethrough configured to admit a portion of product therethrough into the air cell. One of the end flaps can be a front end flap foldably connected to the front panel, wherein the air cell flap is foldably connected to the front end flap opposite the front panel across the front end flap. The air cell flap can include an air cell fold line spaced apart from an end flap fold line connecting the front end flap to the air cell flap, wherein the air cell fold line is spaced apart from the front end flap by a distance that defines thickness of the air cell.

The panels can include an inside panel adhered on an inner surface of the front panel, wherein the air cell flap is foldably connected to the inside panel along an air cell flap fold line. The air cell flap fold line can be offset from a main end flap fold line connecting the end flaps to respective ones of the panels by a distance that defines thickness of the air cell.

An inside panel can be adhered on an inner surface of the front panel, wherein the air cell flap is foldably connected directly to the inside panel along an air cell flap fold line, wherein the end flaps include a front end flap foldably connected to the front end panel along a front end flap fold line, wherein the air cell flap fold line is off set inward from the front end flap fold line by a distance that defines thickness of the air cell. The plurality of panels can be outside panels, wherein the inside panel is an inside front panel foldably connected to at least one additional inside panel reinforcing the outside panels.

A blank for a container includes a plurality of panels connected together at fold lines configured for extending at least partially around an interior space, including a front panel, a first side panel, a back panel and a second side panel. A plurality of end flaps is included, each end flap foldably connected to a respective one of the panels, wherein the end flaps are configured to be overlapped with one another to enclose an end of the interior space. An air cell flap is foldably connected to at least one of the end flaps and/or one of the panels, wherein the air cell flap is configured to be positioned within the interior space inwardly offset from the end flaps to define an air cell between the air cell flap and the end flaps to protect product within the interior space.

A method of assembling a blank into a container includes folding a plurality of panels of a blank connected together at fold lines at least partially around an interior space, wherein the panels include a front panel, a first side panel, a back panel and a second side panel. The method includes overlapping and securing a plurality of end flaps, each end flap foldably connected to a respective one of the panels, wherein the end flaps are overlapped with one another to enclose an end of the interior space. The method includes securing an air cell flap foldably connected to at least one of the end flaps and/or one of the panels to one of the panels so the air cell flap is within the interior space and is inwardly offset from the end flaps to define an air cell between the air cell flap and the end flaps to protect product within the interior space.

Securing air cell flap can be performed before folding the plurality of panels at least partially around the interior space, wherein securing the air cell flap includes folding along an end flap fold line connecting the air cell flap to one of the end flaps and securing an end of the air cell flap opposite the end flap fold line to one of the panels, and folding the air cell flap along two spaced apart air cell fold lines to form the air cell between the air cell flap and the one of the end flaps to which the air cell flap is foldably connected.

The air cell flap can be foldably connected to an inside panel that is foldably connected along an inside panel fold line to one of the plurality of panels and the method can further include folding the blank along the inside panel fold line and adhering the inside panel to an interior surface of one of the panels.

The blank can be a first blank, wherein the air cell flap is foldably connected to an inside panel that is formed of a second blank and the method can further include adhering and the inside panel to an interior surface of one of the panels.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 10 is a perspective view of the blank of FIG. 8, showing the end flaps at one end of the panels after the panels surround the interior space;

FIG. 11 is a perspective view of the blank of FIG. 8, showing the end flaps and air cell flap at the opposite end of the panels from those in FIG. 8;

DETAILED DESCRIPTION OF THE PREFERRED EMBODIMENTS

Figure 1:
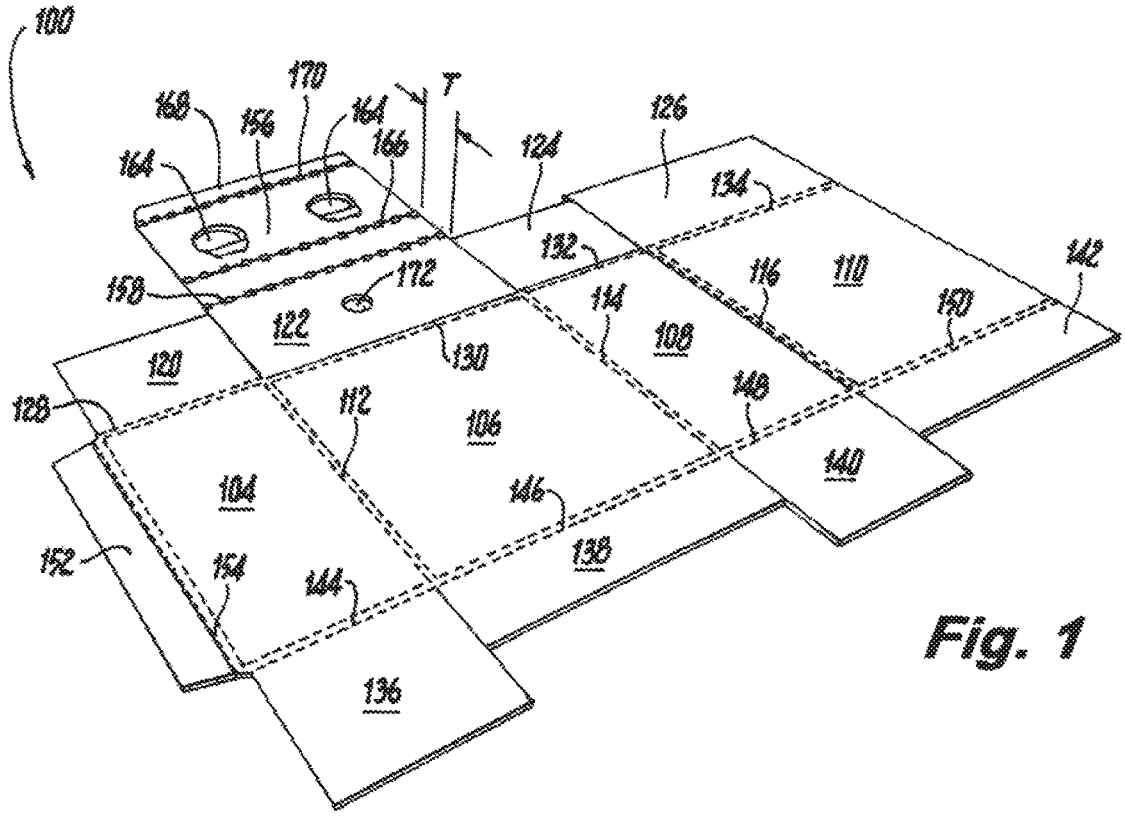
FIG. 1 is a perspective view of an exemplary embodiment of a blank for a container constructed in accordance with the present disclosure, showing the air cell flap foldably connected to an end flap.

Reference will now be made to the drawings wherein like reference numerals identify similar structural features or aspects of the subject disclosure. For purposes of explanation and illustration, and not limitation, a partial view of an exemplary embodiment of a container blank in accordance with the disclosure is shown in FIG. 1 and is designated generally by reference character 100. Other embodiments of containers and blanks in accordance with the disclosure, or aspects thereof, are provided in FIGS. 2-25, as will be described. The systems and methods described herein can be used to provide an air cell for protection of product within a container, e.g. for shipping eCommerce products.

Figure 6:
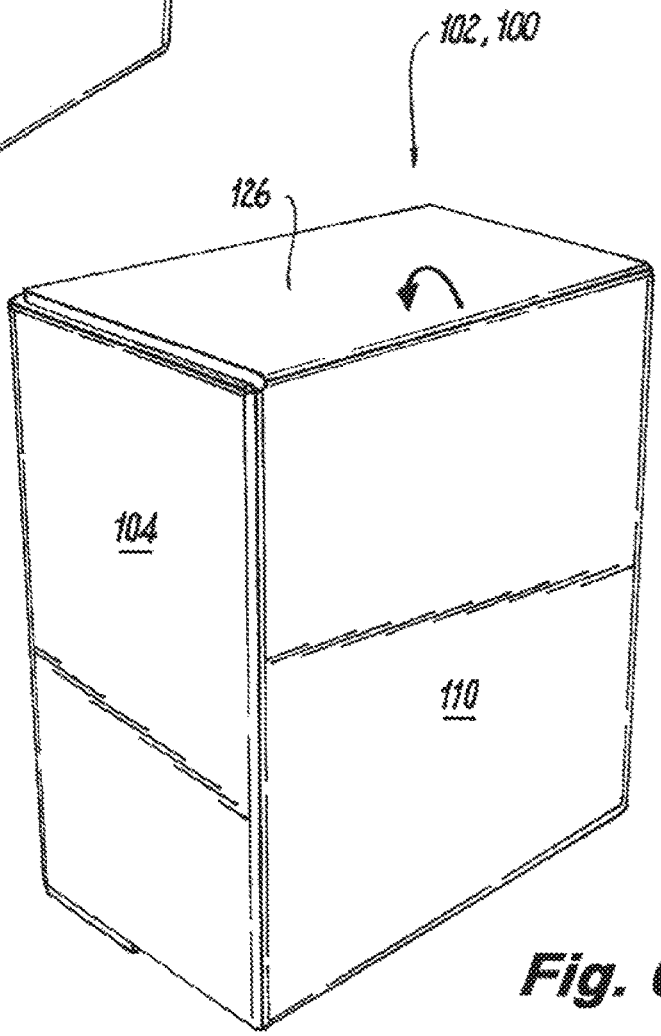
FIG. 6 is a perspective view of the blank of FIG. 1, showing the blank fully formed into a container.
Figure 7:
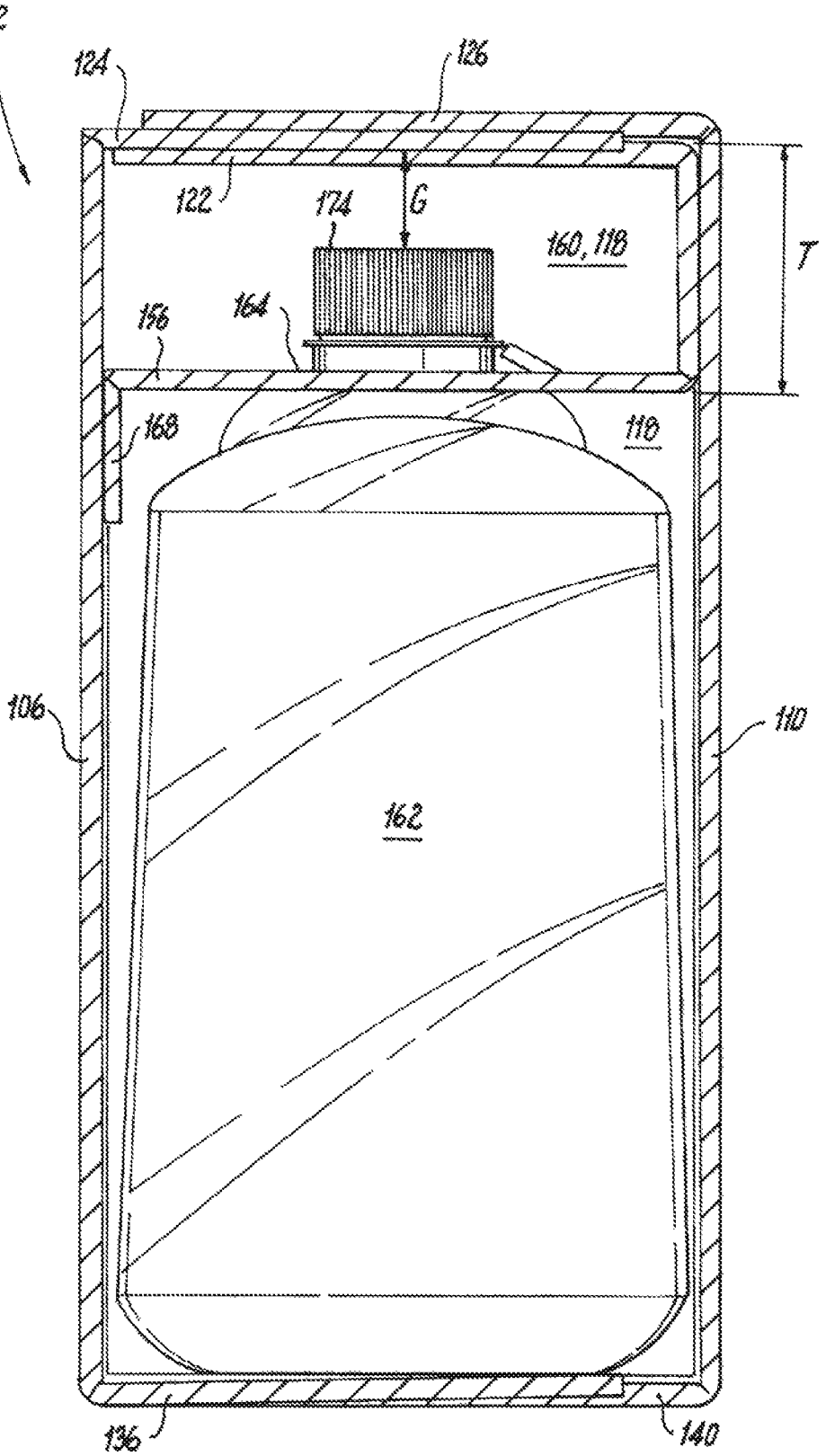
FIG. 7 is a cross-sectional side elevation view of the container of FIG. 6, showing product within the container protected by the air cell.

The blank 100 for a container 102 (shown in FIGS. 6-7) includes a plurality of panels 104, 106, 108, 110 connected together at fold lines 112, 114, 116 configured for extending at least partially around an interior space 118 (labeled in FIG. 7). The panels include a front panel 106, a first side panel 104, a back panel 110, and a second side panel 108. A plurality of end flaps 120, 122, 124, 126 is included, each end flap 120, 122, 124, 126 foldably connected to a respective one of the panels 104, 106, 108, 110 by a respective fold line 128, 130, 132, 134, wherein the end flaps 120, 122, 124, 126 are configured to be overlapped with one another to enclose a first end of the interior space 118. Another similar set of end flaps 136, 138, 140, 142 and respective fold lines 144, 146, 148, 150 is included at the opposite end of the blank 100 for enclosing the second end of the interior space 118 opposite the first end. A closure flap 152 is foldably connected to the first side panel 104 along the fold line 154 for adhesion to the back panel 110 when enclosing the interior space 118 with the blank 100.

An air cell flap 156 is foldably connected to the end flaps 122 along an end flap fold line 158. The air cell flap 156 is configured to be positioned within the interior space 118 inwardly offset from the end flaps 120, 122, 124, 126 to define an air cell 160 (labeled in FIG. 7) between the air cell flap 156 and the end flaps 120, 122, 124, 126 to protect product 162 (labeled in FIG. 7) within the interior space 118. The air cell flap 156 defines two product apertures 164 therethrough configured to admit a portion of product 162 therethrough into the air cell 160 as shown in FIG. 7. The product apertures 164 can also cradle the product 162 to protect, e.g., bottle tops, from damage during shipping.

The end flap 122 is a front end flap foldably connected to the front panel 106, wherein the air cell flap 156 is foldably connected to the front end flap 122 opposite the front panel 106 across the front end flap 122 along the end flap fold line 158. The air cell flap 156 includes an air cell fold line 166 spaced apart from the end flap fold line 158, wherein the air cell fold line 166 is spaced apart from the front end flap 122 by a distance T that defines thickness T of the air cell 160 as indicated in FIGS. 1 and 7. The air cell flap 156 includes an adhesive flap 168 foldably connected to the main portion of the air cell flap 156 by air cell fold line 170. The front end flap 122 includes an aperture 172 therethrough, e.g. to allow finger access into the air cell 160 to facilitate removal of the product 162 from the container 102.

Figure 2:
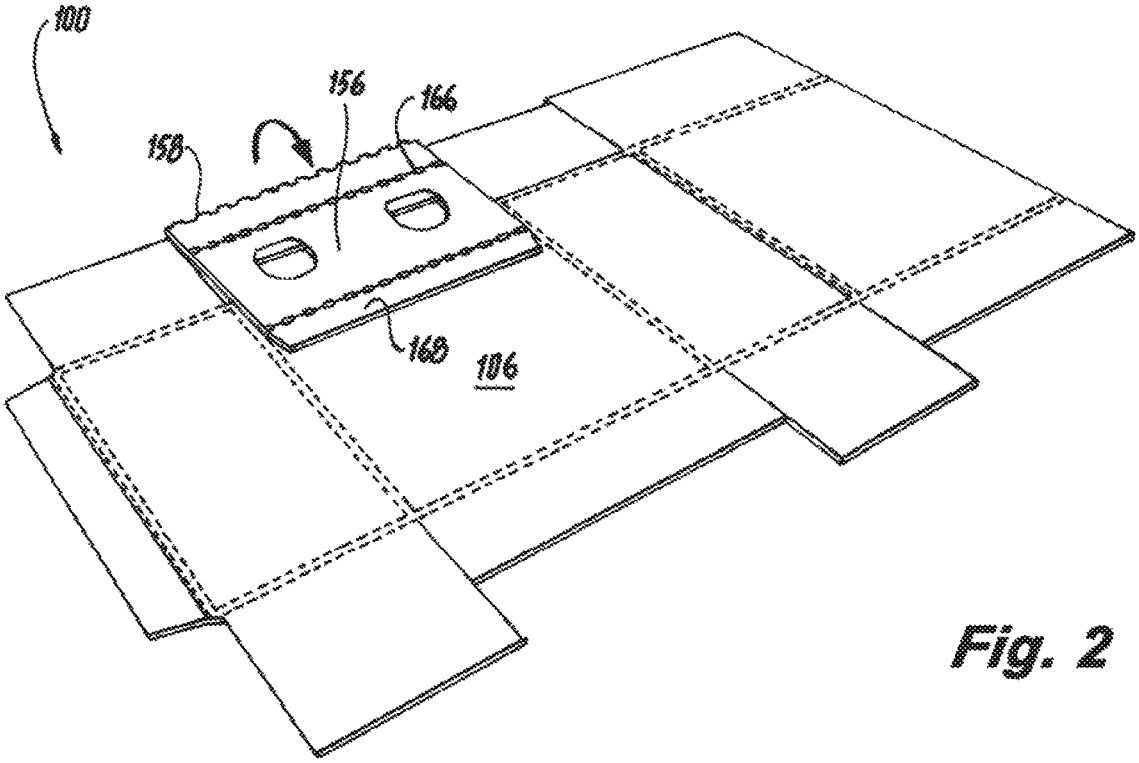
FIG. 2 is a perspective view of the blank of FIG. 1, showing the air cell flap secured to the front panel.
Figure 3:
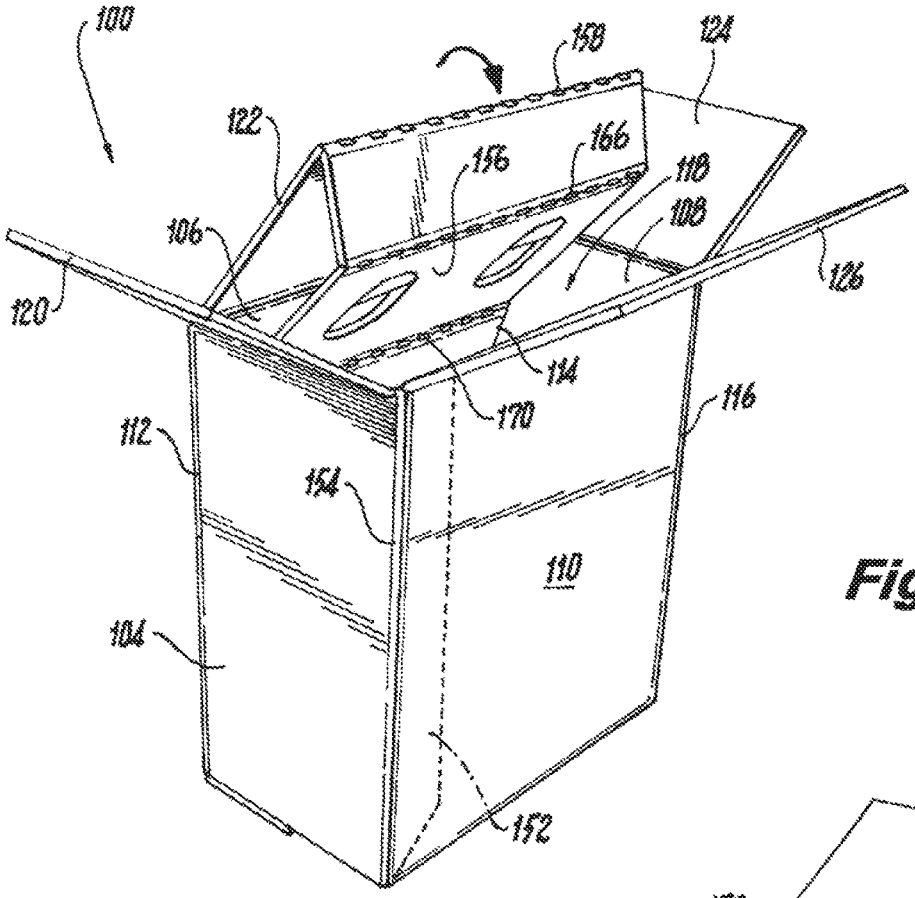
FIG. 3 is a perspective view of the blank of FIG. 1, showing the panels formed to enclose the interior space with the air cell flap and associated end flap being moved to final position.
Figure 4:
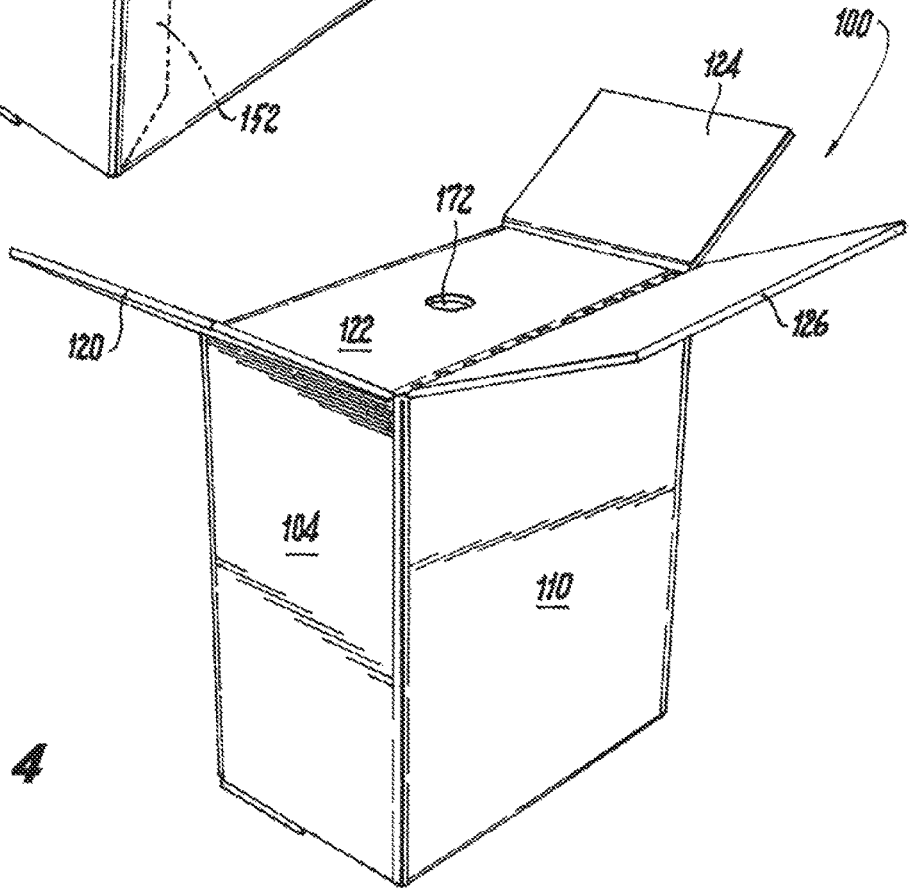
FIGS. 4-5 are perspective views of the blank of FIG. 1, showing two more stages of overlapping the end flaps to enclose the interior space of the container.
Figure 5:
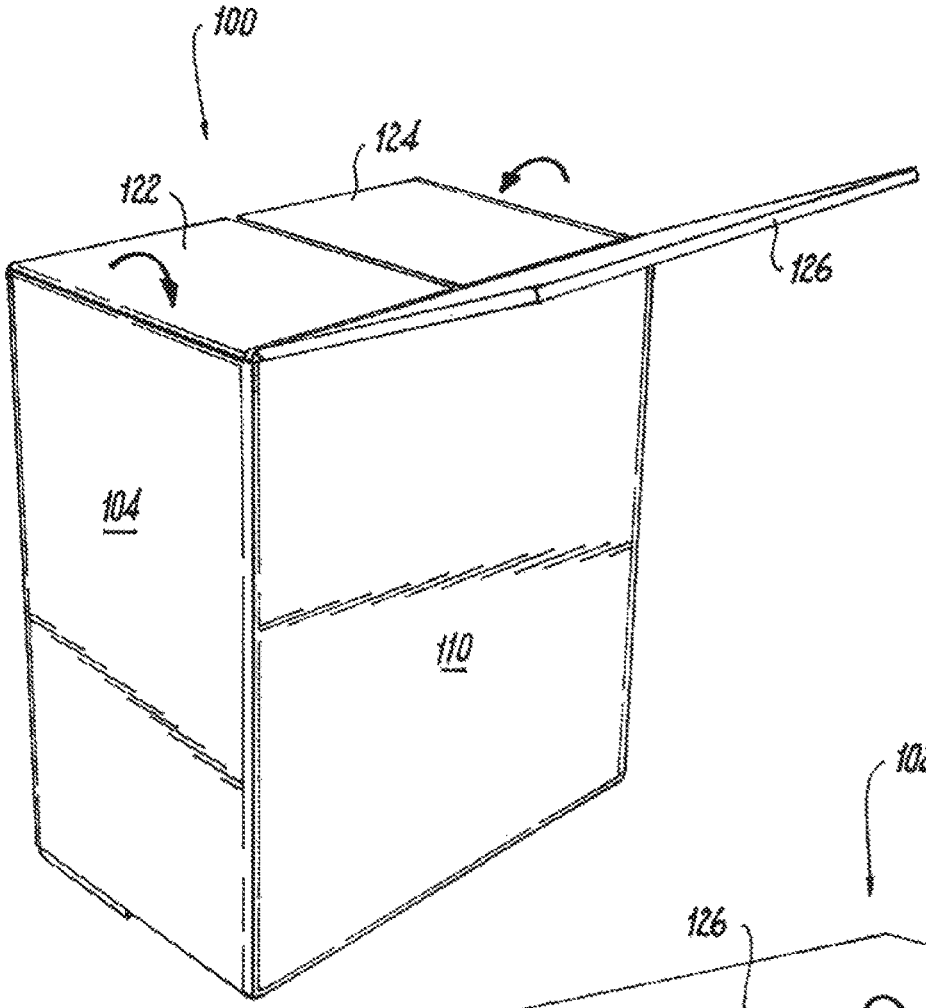

With reference now to FIGS. 2-6, a method of assembling the blank 100 of FIG. 1 into the container 102 of FIG. 6 includes securing an air cell flap 156 to the front panel 106, e.g., by folding the air cell flap over the front end flap 122 along the end flap fold line 158 and adhering the adhesive flap 168 to an interior surface of the front panel 106 as indicated with the fold arrow in FIG. 2. As shown in FIG. 3, the panels 104, 106, 108, 110 are folded along fold lines 112, 114, 116 at least partially around an interior space, and are secured in position by folding along fold line 154 and adhering the closure flap 152 to back flap 110. The end flaps 120, 122, 124, 126 are folded inward and are overlapped with one another to enclose the end (e.g., the top end as oriented in FIG. 3) of the interior space 118. The lower end as oriented in FIG. 3 is similarly enclosed by overlapping the end flaps 136, 138, 140, 142 and adhering them together, albeit there is no air cell flap 156 in the lower end. While not shown in FIG. 3, the product 162 shown in FIG. 7 can be placed into the interior space 118 prior to closing the air cell flap 156. As shown in FIG. 3, as the front end flap 122 is closed by folding it downward toward the interior space 118. The fold lines 158, 166, and 170 hinge to move the air cell flap 156 within the interior space 118 so it is inwardly offset by distance T from the end flaps 120, 122, 124, 126 to define the air cell 160 between the air cell flap 156 and the end flaps 120, 122, 124, 126 to protect product 162 within the interior space 118. With the front end flap 122 in position as shown in FIG. 4, the end flaps 120 and 122 can be folded and overlapped with and adhered to the front end flap 122 as shown in FIG. 5. Finally, the end flap 126 can be folded to overlap with the end flaps 120 and 122 and adhered in place as shown in FIG. 6 to complete the formation of the container 102 from the blank 100 with the product 162 inside as shown in FIG. 7.

As shown in FIG. 7, the product 162 includes a bottle, the cap 174 of which is inside the air cell 118 by way of the product aperture 164 in the air cell flap 156. Container 102 has two product apertures 164 for packaging two bottles in tandem. The air cell flap 156 holds the product 162 downward as oriented in FIG. 7 and maintains a gap G between the product 162 and the end flaps 120, 122, 124, 126 to protect the product, e.g., from impact during shipping.

Figure 8:
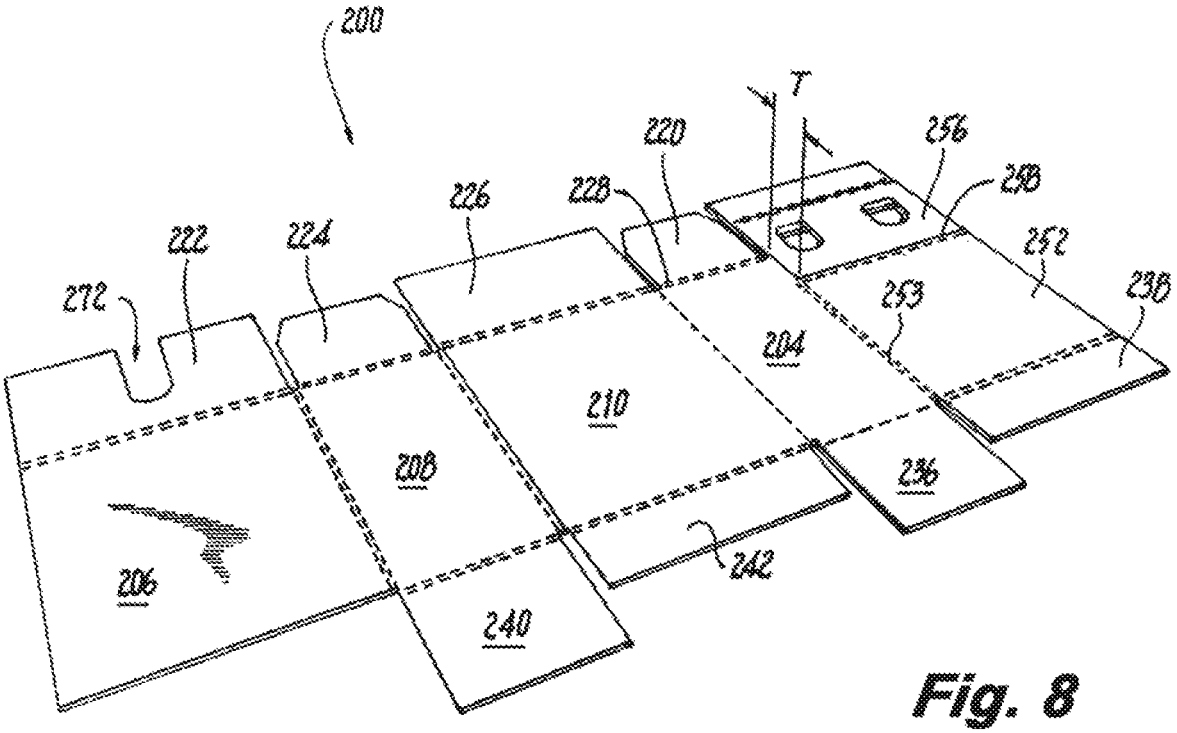
FIG. 8 is a perspective view of another exemplary embodiment of a blank for a container constructed in accordance with the present disclosure, showing the air cell flap foldably connected to an inside panel that is foldably connected to one of the outside panels.

With reference now to FIG. 8, another exemplary embodiment of a blank 200 is shown, having panels 204, 206, 208, 210 and end flaps 220, 222, 224, 226, 236, 238, 240, 242 similar to those described above with respect to blank 100. However, an inside panel 252 connected to the side panel 204 has the bottom flap 238 and air cell flap 256 foldably connected thereto. The inside panel 252 is shorter than the adjacent panels 204, 206, 208, 210 so the air cell flap fold line 258 is offset by a distance T from the fold line 228 connecting the end flap 220 to the side panel 204 (which is contiguous with the main end flap fold line for this end of the blank 200). There is no need for an additional air cell fold line 166 described above. The aperture 272 through the front end flap 222 is u-shaped, but serves a similar purpose to that described above with reference to aperture 172.

Figure 9:
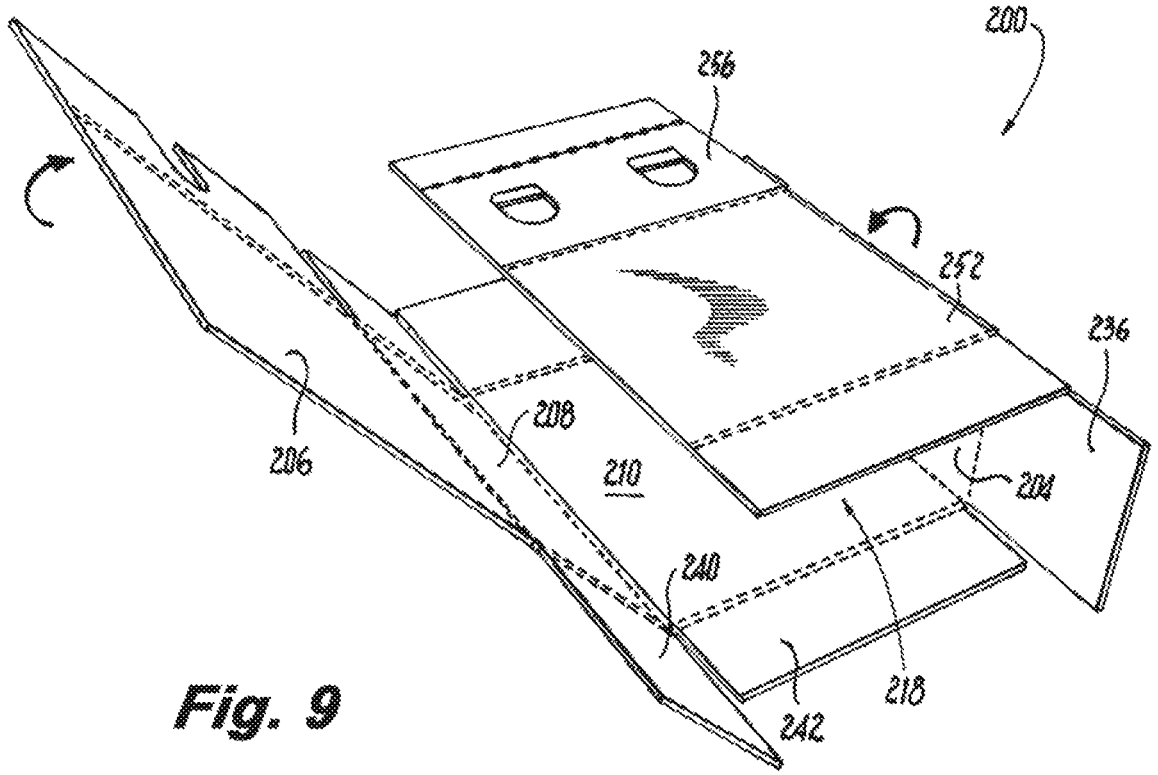
FIG. 9 is a perspective view of the blank of FIG. 8, showing the panels being folded around the interior space.
Figure 12:
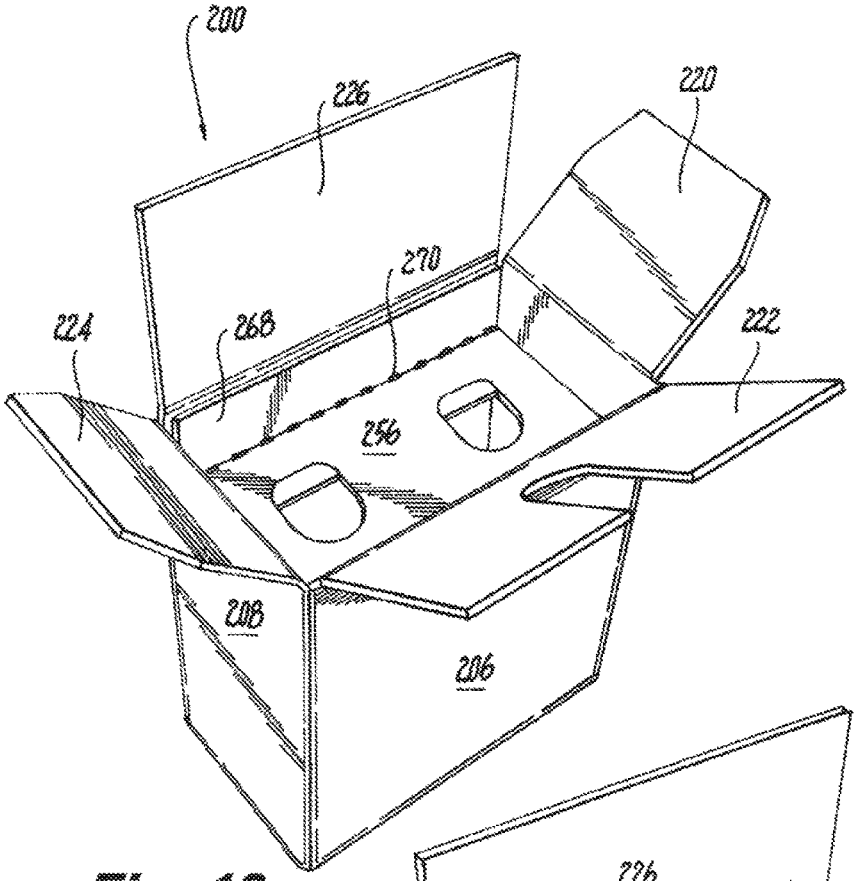
FIG. 12 is a perspective view of the blank of FIG. 8, showing the air cell flap secured to the interior surface of one of the outside panels.
Figure 13:
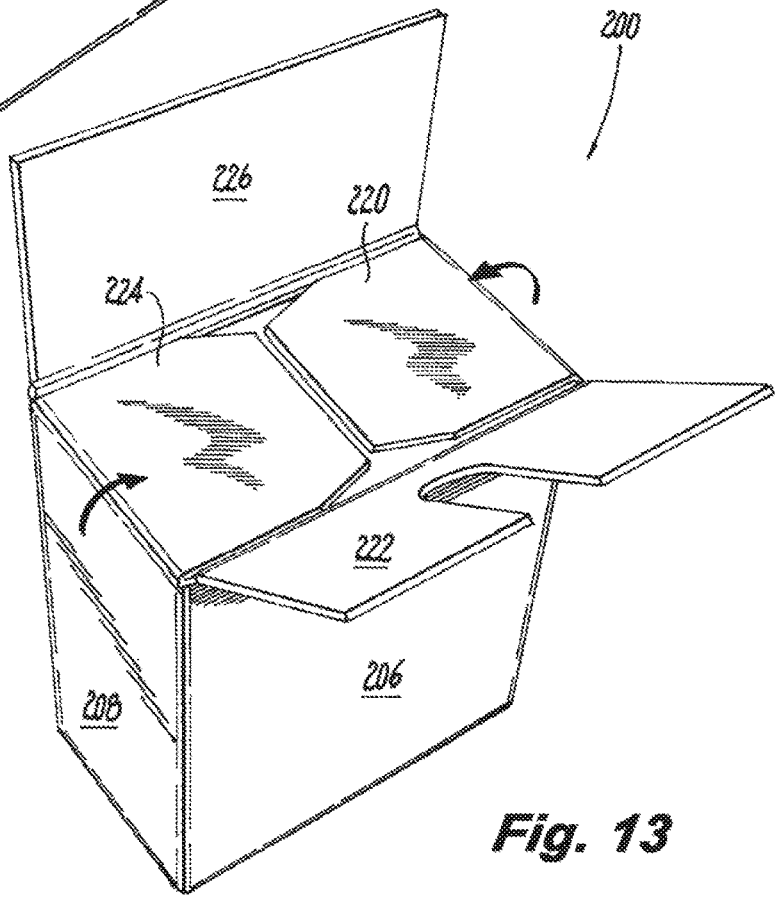
FIGS. 13-14 are perspective views of the blank of FIG. 8, showing two stages of overlapping the end flaps to enclose the interior space of the container.
Figure 14:
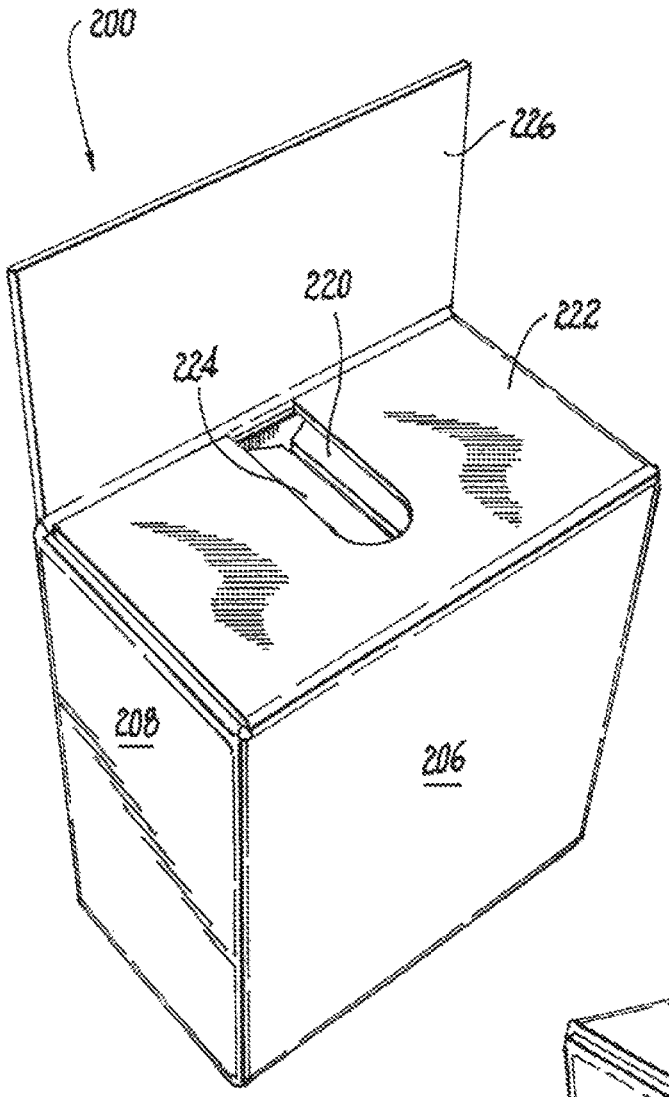
Figure 15:
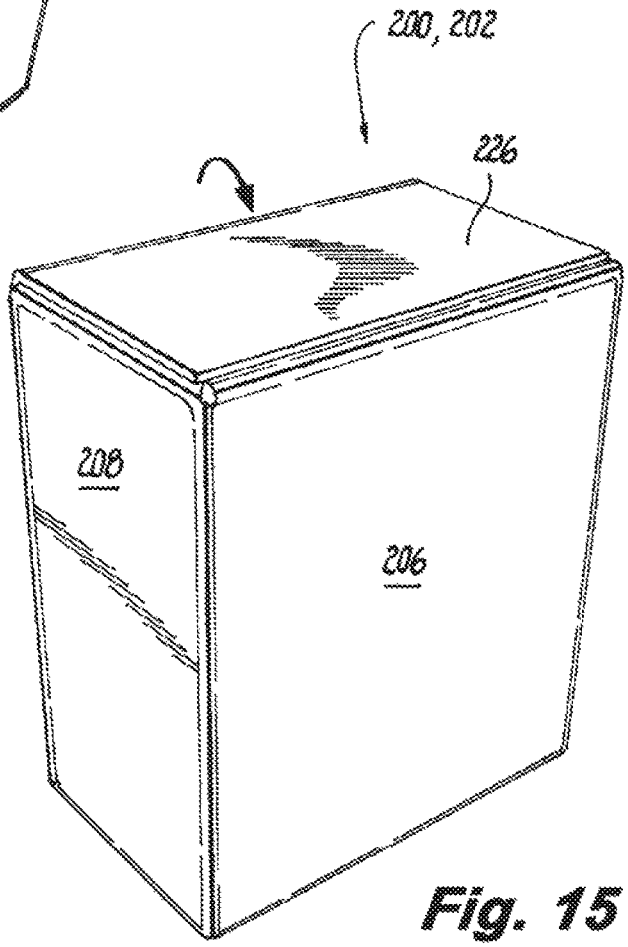
FIG. 15 is a perspective view of the blank of FIG. 8, showing the blank fully formed into a container.
Figure 16:
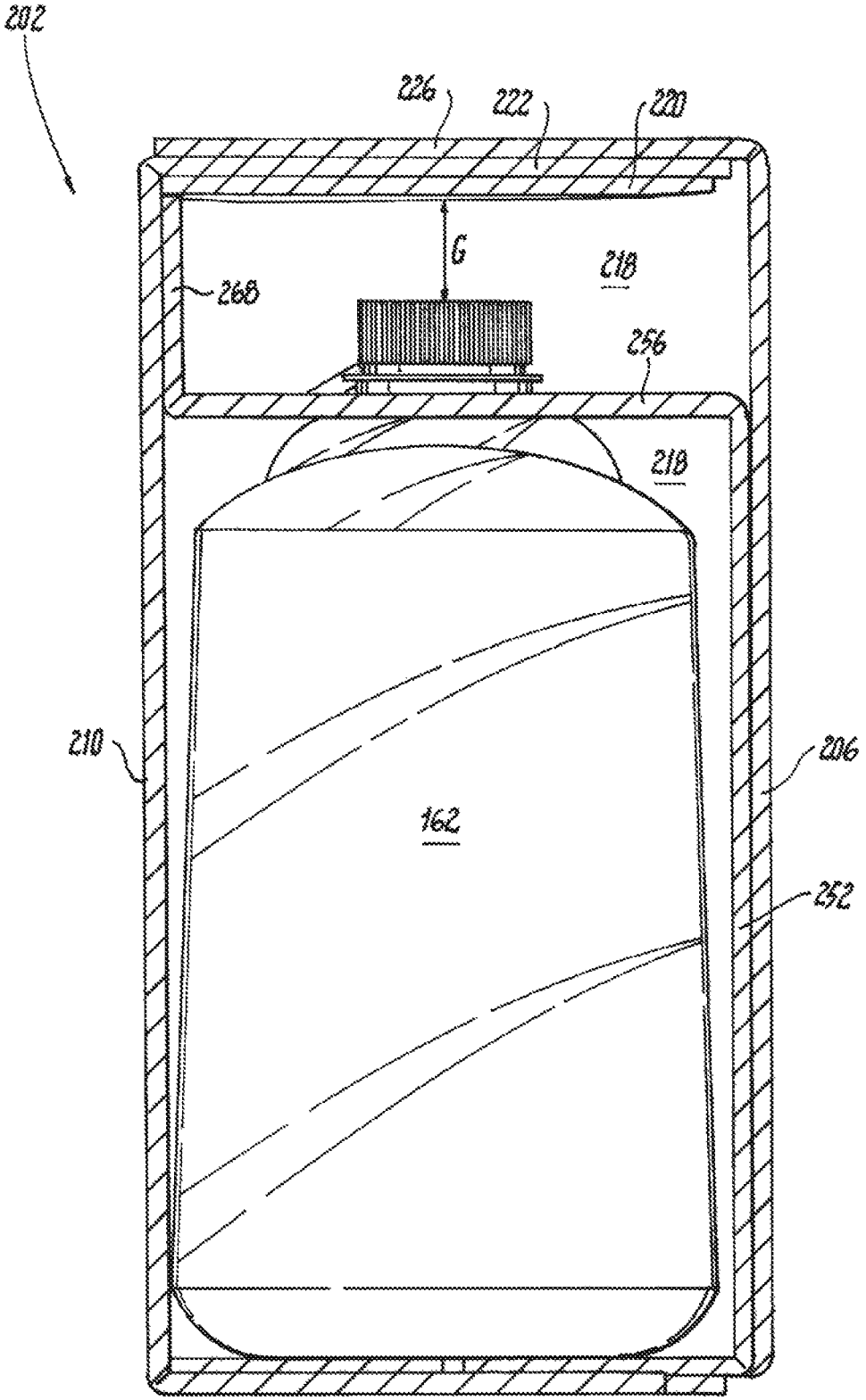
FIG. 16 is a cross-sectional side elevation view of the container of FIG. 15, showing product within the container protected by the air cell.

With reference now to FIGS. 9-16, forming a container 202 from the blank 200 is described. As shown in FIG. 9, the outside panels 204, 206, 208, 210, and the inside panel 252 are folded around an interior space 218 in much the same manner as described with respect to the blank 100, folding along an inside panel fold line 253 and bringing the inside panel 252 against the inside surface of the front panel 206 and adhering the inside panel 252 to the interior surface of the front panel 206 as shown in FIG. 10. The end flaps 236, 238, 240, 242 can be folded and secured to enclose the lower end of the interior space 118 as oriented in FIG. 11. Product 162 (shown in FIG. 16) can be placed into the interior space 218 with the blank in the configuration shown in FIG. 11, then the air cell flap 256 can be folded into the interior space 218 along the air cell fold line 258. The second air cell fold line 270 can be folded to allow adhesion of the adhesive flap 268 against the interior surface of back panel 210 as shown in FIG. 12. End flaps 220 and 224 are folded inward as shown in FIG. 13, then the end flap 220 can be folded to overlap and be adhered to the end flaps 220 and 224. Finally, the end flap 226 can be folded to overlap with and be adhered to the end flap 220 to form the complete container 202 as shown in FIG. 15. As shown in FIG. 16, the air cell flap 256 divides part of the interior space 118 into an air cell 260 and provides the clearance gap G as described above with reference to container 202.

Figure 17:
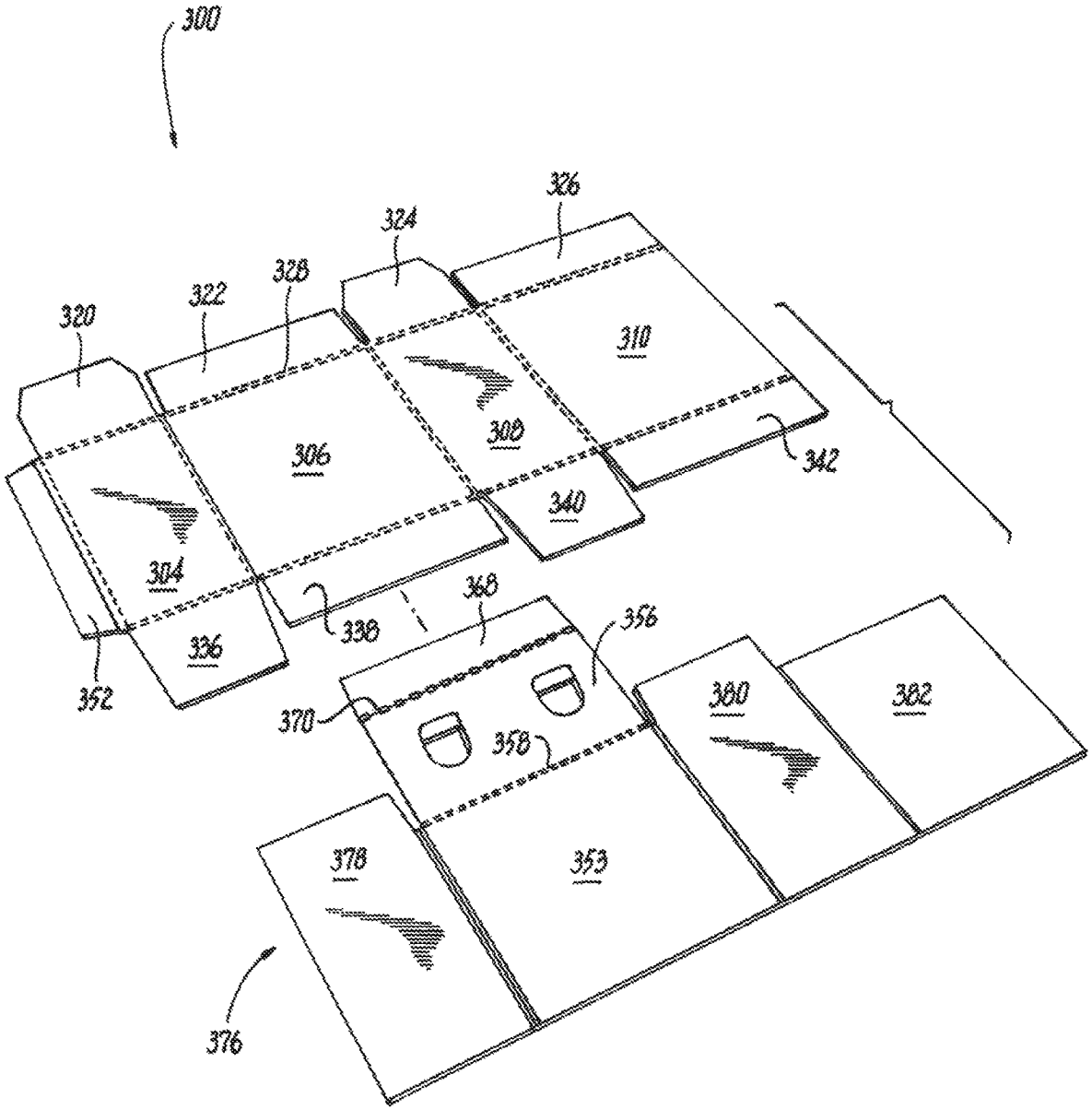
FIG. 17 is a perspective view of another exemplary embodiment of a blank for a container constructed in accordance with the present disclosure, showing the air cell flap foldably connected to an inside panel that is on a second blank.
Figure 18:
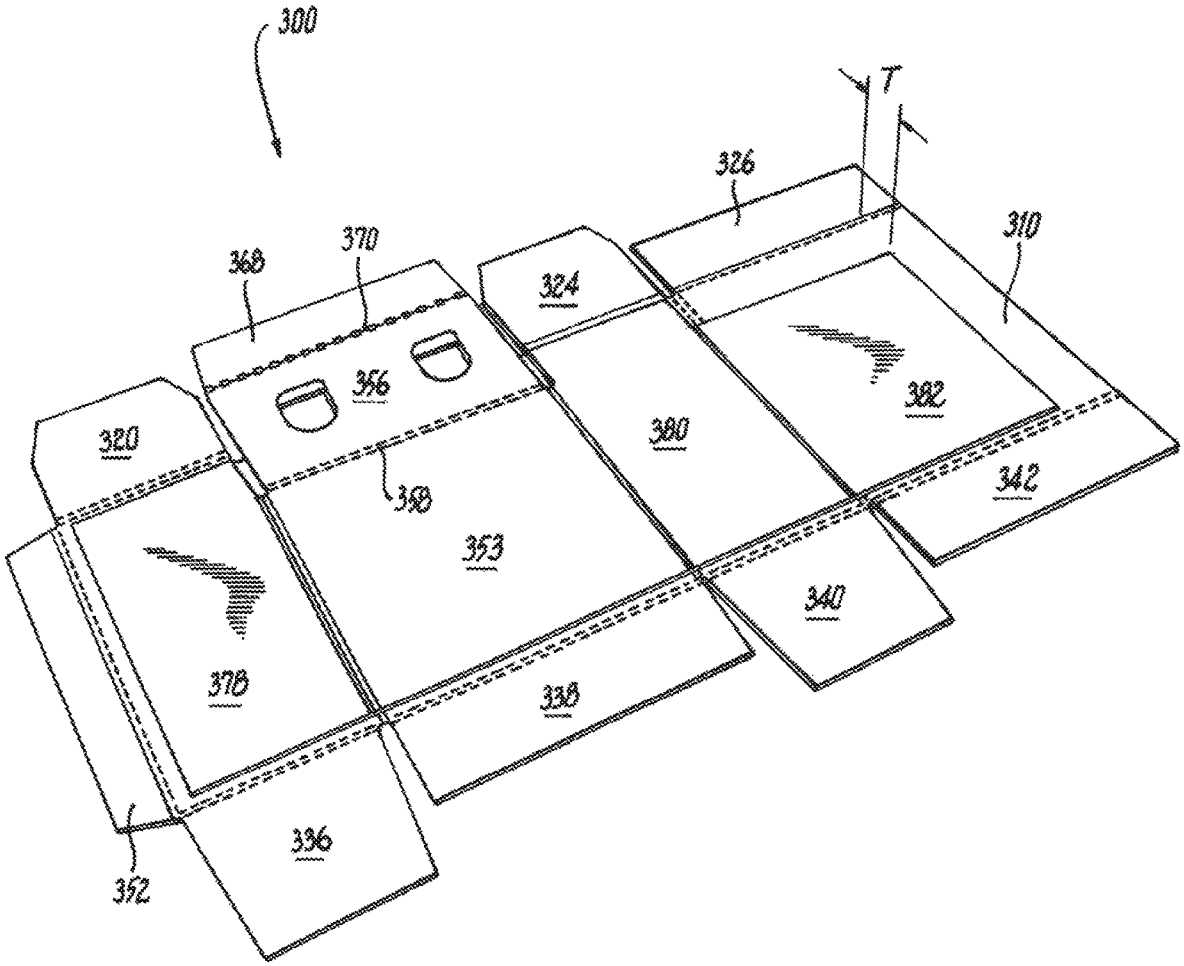
FIG. 18 is a perspective view of the blank of FIG. 17, showing the inside panel blank adhered to interior surfaces of the outside panels.

With reference now to FIGS. 17-25, another exemplary embodiment of a blank 300 is shown, having panels 304, 306, 308, 310 and end flaps 320, 322, 324, 326, 336, 338, 340, 342 similar to those described above with respect to blank 100. However, as separate reinforcement blank 376 is provided with an inside panel 353 foldably connected to reinforcement panels 378, 380, and 382. The air cell flap 356 is foldably connected directly to the front inside panel 353, and after assembly it is thus foldably connected indirectly to the front panel 306. The reinforcement blank 376 is adhered to the inner surface of the blank 300 as shown in FIG. 18, with respective reinforcement panels 378, 380, 382 and inside panel 353 aligned with the fold lines connecting the outside panels 304, 306, 308, 310. The inside panel 353 is adhered inside the front panel 306. The inside panel 252 is shorter than the outside panels 304, 306, 308, 310 so the air cell flap fold line 358 is offset by a distance T from the fold line 328 connecting the end flap 322 to the front panel 306, as shown in FIGS. 17-18. This offset distance T allows the air cell flap 356 to form an air cell much as described above with respect to container 202.

Figure 19:
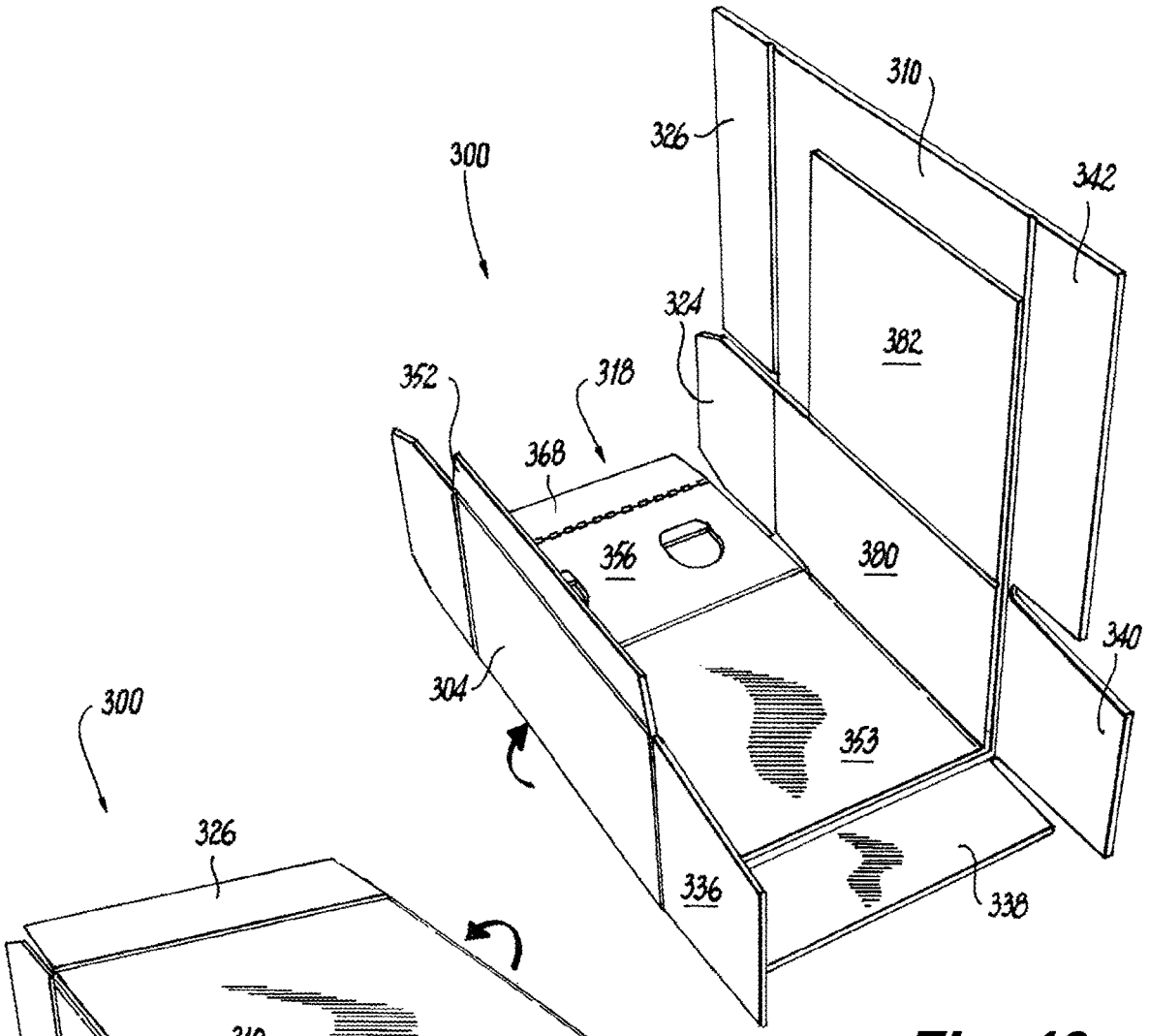
FIGS. 19-20 are perspective views of the blank of FIG. 17, showing two stages of the panels being folded around the interior space.
Figure 20:
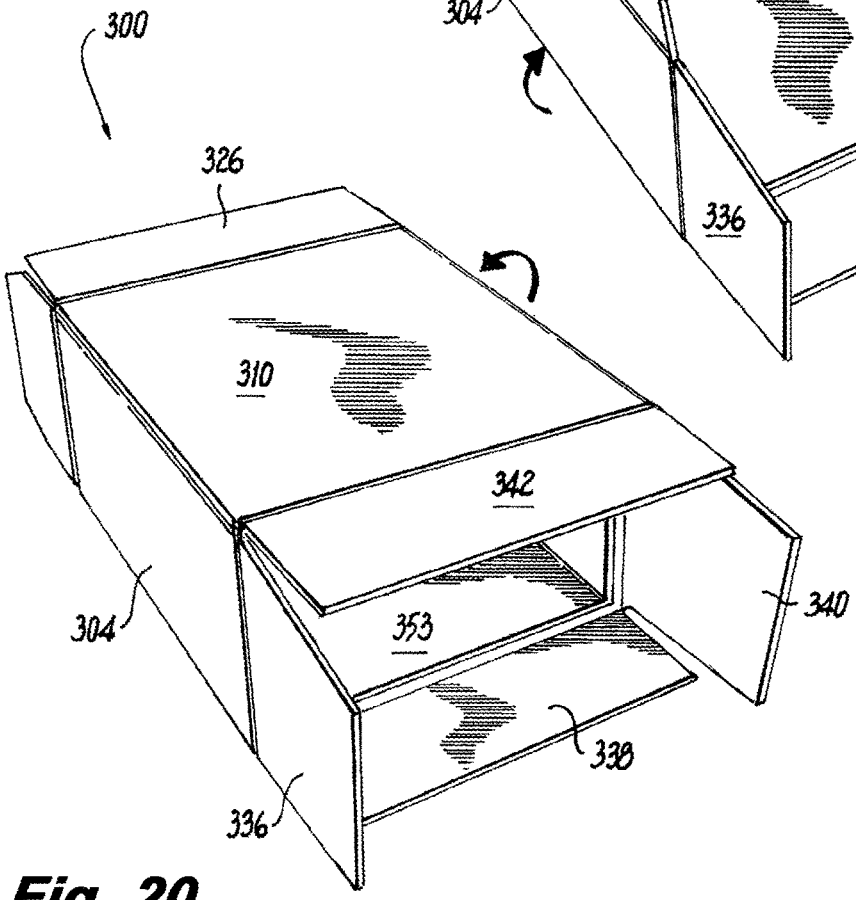
Figure 21:
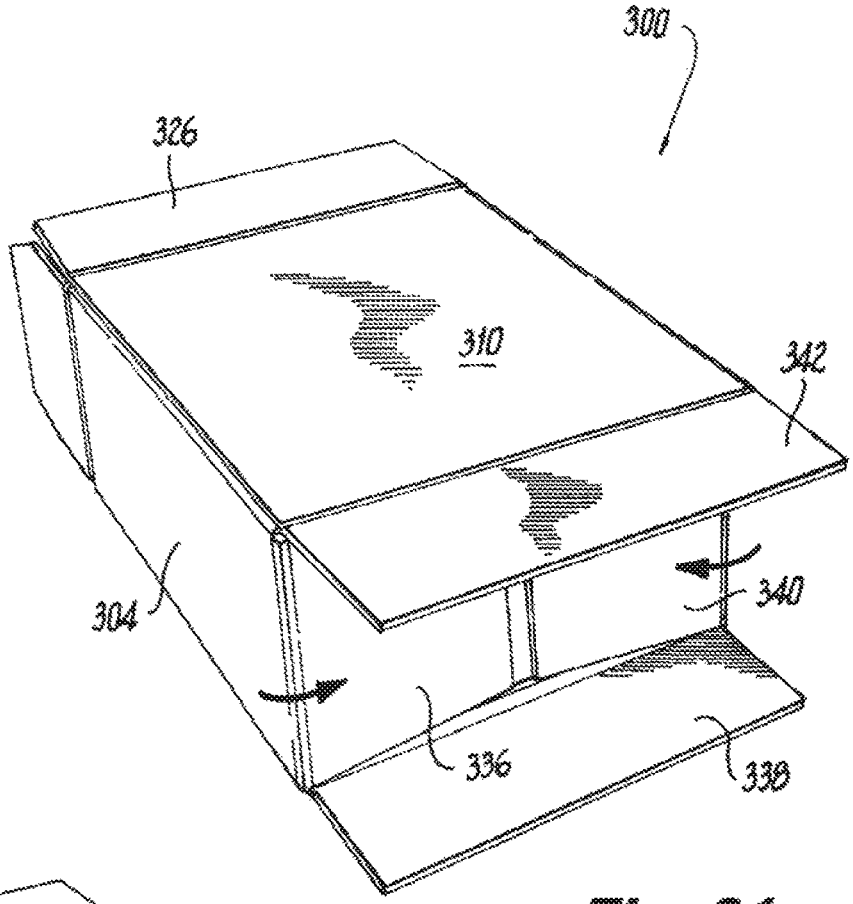
FIGS. 21-22 are perspective views of the blank of FIG. 17, showing two stages of the end flaps at one end of the panels being overlapped.
Figure 22:
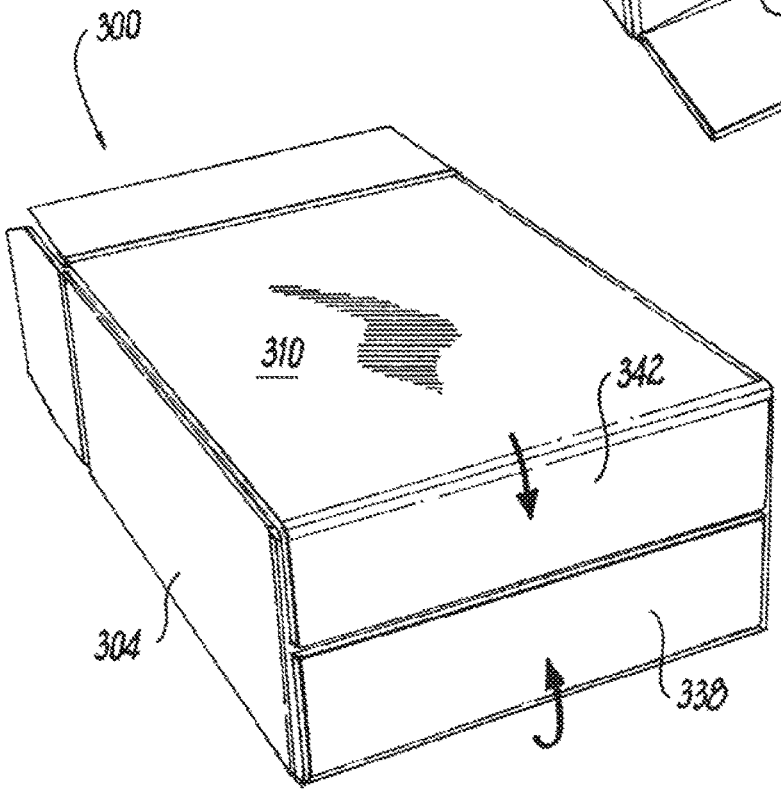
Figure 23:
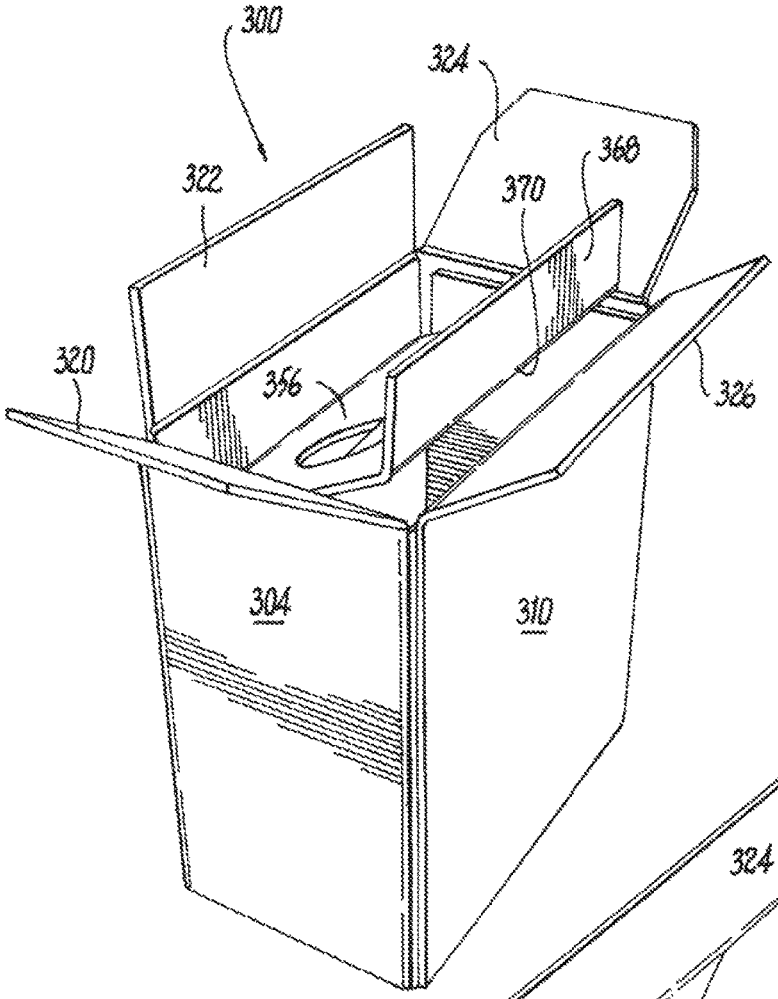
FIG. 23 is a perspective view of the blank of FIG. 17 viewing the end of the blank opposite that of FIGS. 21-22, showing the air cell flap being secured to the interior surface of one of the outside panels.
Figure 24:
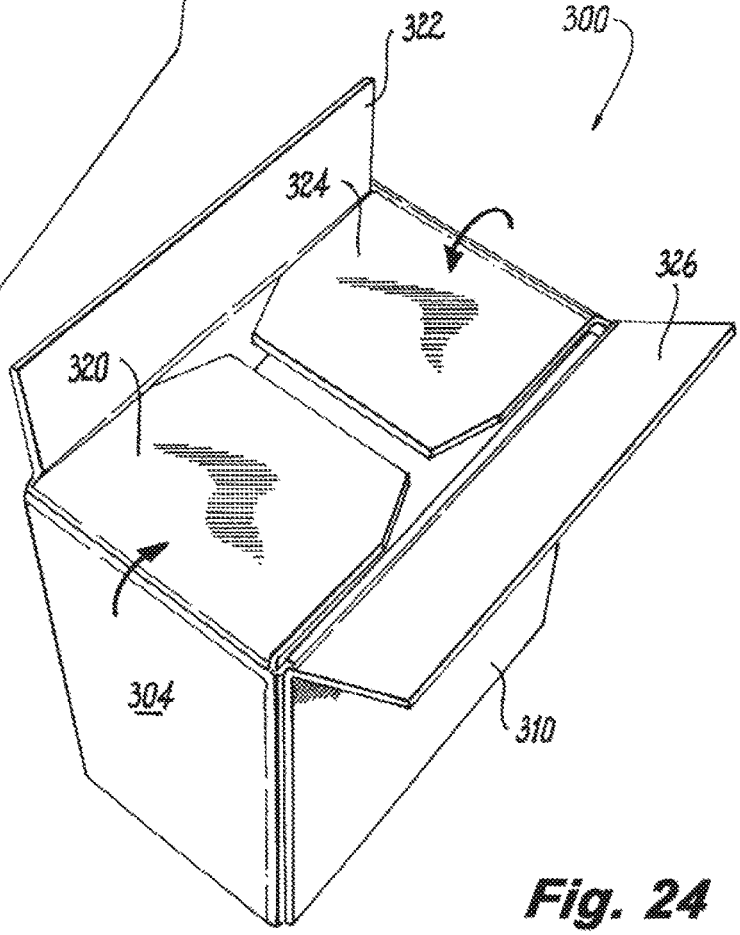
FIG. 24 is a perspective view of the blank of FIG. 17, showing overlapping of the end flaps to enclose the interior space of the container.
Figure 25:
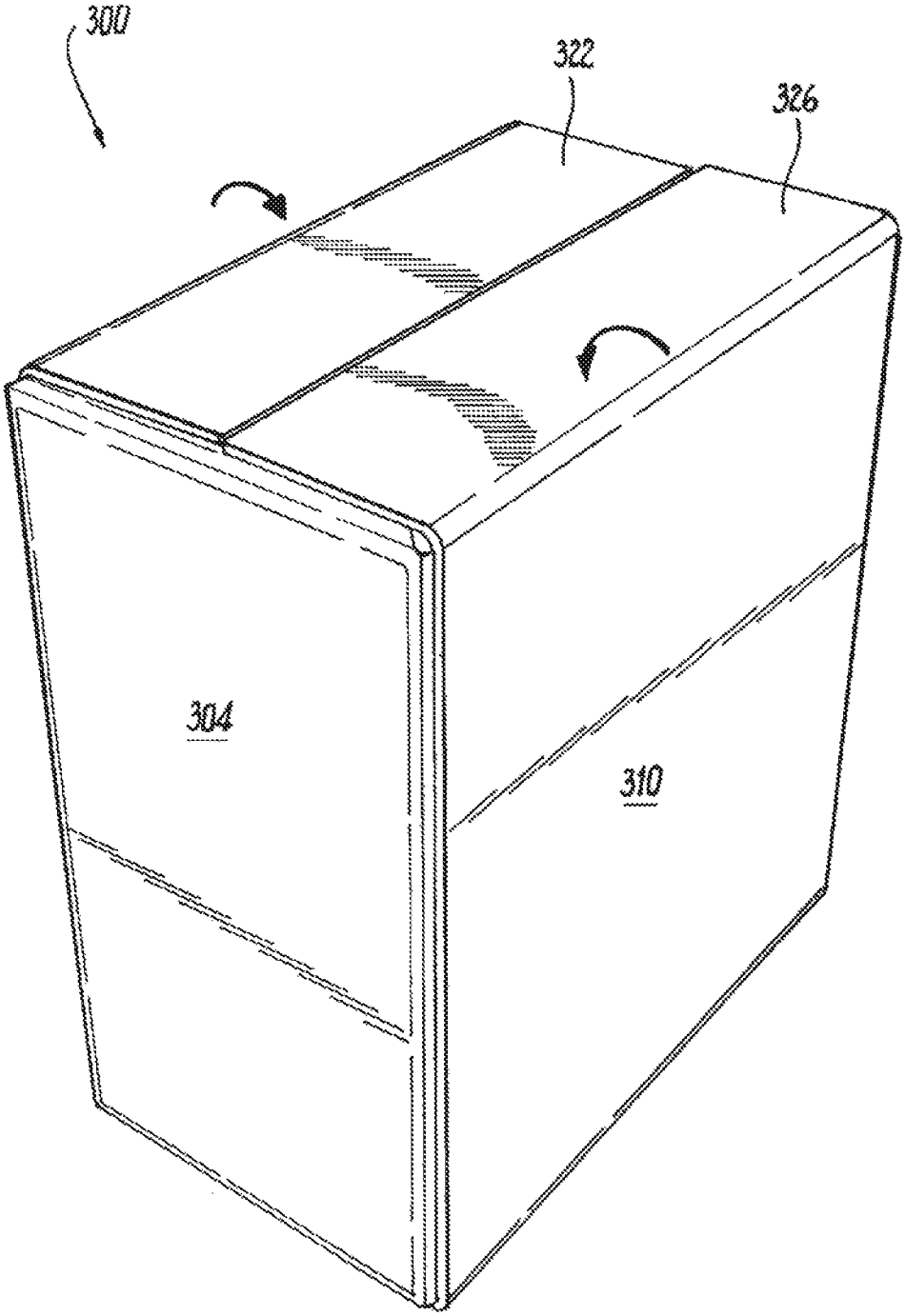
FIG. 25 is a perspective view of the blank of FIG. 17, showing the blank fully formed into a container.

The outside panels 304, 306, 308, 310 can be folded along their respective fold lines as shown in FIG. 19, which also folds the inside panel 353 and reinforcement panels 378, 380, 382, to begin enclosing the interior space 318. As shown in FIGS. 19 and 20, the adhesion flap 352 is folded and adhered to in inner surface of back panel 310 much as described above with reference to blank 100. The end flaps 336, 338, 340, 342 can be folded inward, overlapped with one another and adhered together to enclose the one end of the interior space 318 as shown in FIGS. 21-22. As shown in FIGS. 23-25 securing the air cell flap 356 can be performed in the same manner as described above with respect to blank 200, and the end flaps 320 and 324 are folded inward, and finally the end flaps 322 and 326 are overlapped with the end flaps 320 and 324 and adhered into place to form the complete container 302 shown in FIG. 25.

While shown and described in the exemplary context of bottled products, those skilled in the art will readily appreciation that any other suitable product can be packaged without departing from the scope of this disclosure. Blanks and containers as disclosed herein can be constructed of any suitable material such as corrugated paper board.

The methods and systems of the present disclosure, as described above and shown in the drawings, provide for blanks and containers with superior properties including improved protection for product such as in eCommerce shipping. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A container comprising:

a plurality of panels connected together at fold lines configured for extending at least partially around an interior space, including a front panel;

a plurality of end flaps, each end flap foldably connected to a respective one of the panels, wherein the end flaps are overlapped with one another to enclose an end of the interior space;

an air cell flap within the interior space and inwardly offset from the end flaps to define an air cell between the air cell flap and the end flaps to protect product within the interior space; and an inside panel adhered on an inner surface of the front panel, wherein the air cell flap is foldably connected directly to the inside panel along an air cell flap fold line, wherein the air cell flap fold line is offset from a main end flap fold line connecting the end flaps to respective ones of the panels by a distance that defines thickness of the air cell.

2. A container comprising:

a plurality of panels connected together at fold lines configured for extending at least partially around an interior space, including a front panel, a first side panel, a back panel and a second side panel;

a plurality of end flaps, each end flap foldably connected to a respective one of the panels, wherein the end flaps are overlapped with one another to enclose an end of the interior space;

an air cell flap within the interior space and inwardly offset from the end flaps to define an air cell between the air cell flap and the end flaps to protect product within the interior space; and an inside panel adhered on an inner surface of the front panel, wherein the air cell flap is foldably connected directly to the inside panel along an air cell flap fold line, wherein the end flaps include a front end flap foldably connected to the front end panel along a front end flap fold line, wherein the air cell flap fold line is off set inward from the front end flap fold line by a distance that defines thickness of the air cell.

3. The container as recited in claim 2, wherein the plurality of panels are outside panels, wherein the inside panel is an inside front panel foldably connected to at least one additional inside panel reinforcing the outside panels.

4. A container comprising:

a plurality of panels connected together at fold lines configured for extending at least partially around an interior space, including a front panel;

a plurality of end flaps, each end flap foldably connected to a respective one of the panels, wherein the end flaps are overlapped with one another to enclose an end of the interior space;

an air cell flap within the interior space and inwardly offset from the end flaps to define an air cell between the air cell flap and the end flaps to protect product within the interior space; and an inside panel adhered on an inner surface of the front panel, wherein the air cell flap is foldably connected directly to the inside panel along an air cell flap fold line, wherein the air cell flap defines at least one product aperture therethrough configured to admit a portion of product therethrough into the air cell.

* * * * *